United States Patent [19]

Matsuda et al.

[11] Patent Number: 4,838,537

[45] Date of Patent: Jun. 13, 1989

[54] AUTOMATIC SHEET WINDING AND DISCHARGING DEVICE

[75] Inventors: Hideo Matsuda, Nara; Shinitiro Hiraoka, Yamatotakada, both of Japan

[73] Assignee: Sharp Kabushiki Kaisha, Osaka, Japan

[21] Appl. No.: 177,906

[22] Filed: Apr. 4, 1988

Related U.S. Application Data

[63] Continuation of Ser. No. 816,864, Jan. 7, 1986, abandoned.

[30] Foreign Application Priority Data

Jan. 11, 1985 [JP] Japan ..... 60-3678
Feb. 26, 1985 [JP] Japan ..... 60-39766

[51] Int. Cl.[4] ..... B65H 5/12

[52] U.S. Cl. ..... 271/277; 271/86; 355/75

[58] Field of Search ..... 271/272, 274, 275, 277; 355/82, 75

[56] References Cited

U.S. PATENT DOCUMENTS 3,427,965 2/1969 Turner .
3,734,015 5/1973 Caris ..... 271/277
3,744,791 7/1973 Bongers .
4,132,403 1/1979 Weisbach et al. ..... 271/277
4,358,100 11/1982 Muller ..... 271/277
4,390,176 6/1983 Kato ..... 271/277

FOREIGN PATENT DOCUMENTS 2729137 1/1978 Fed. Rep. of Germany .
1470316 4/1977 United Kingdom ..... 271/277

OTHER PUBLICATIONS

IBM Technical Disclosure Bulletin, "Paper Drum Tensioning Rollers", by Buddington et al., p. 3471.

*Primary Examiner*—H. Grant Skaggs
*Attorney, Agent, or Firm*—Birch, Stewart, Kolasch & Birch

[57] ABSTRACT

Described is an automatic sheet winding and discharging device which includes of the following: a rotary drum for winding a sheet onto it; a sheet holding device provided on the circumferential surface of the rotary drum to sandwich the tip-end of the wound-up sheet; a sheet holding roller unit provided in the vicinity of the sheet discharger unit for pressing the sheet wound onto the rotary drum surface; and a device for allowing the sheet-holding roller unit to either come into contact with or separate from the surface of the rotary drum in conjunction with the operations for automatically winding and discharging a sheet onto and from the surface of the rotary drum.

3 Claims, 6 Drawing Sheets

AUTOMATIC SHEET WINDING AND DISCHARGING DEVICE

This application is a continuation of application Ser. No. 816,864 filed on Jan. 7, 1986, now abandoned.

BACKGROUND OF THE INVENTION

The present invention relates to an automatic sheet winding and discharging device that automatically winds a variety of sheets such as paper and film onto a rotary drum and discharges them from it. In particular, this device precisely controls a pressure roller so that a sheet can be pressed against the circumferential surface of the drum only when the pressing operation is executed, thus effectively preventing any stain on the roller from passing to sheets being fed in succession.

DESCRIPTION OF PRIOR ART

Any conventional facsimile device, copying machine, printer or similar mechanism employs a device that automatically winds either the recording paper or the draft paper onto the drum and then automatically discharges the printed paper/drafts from the mechanism. Conventionally, any such device is provided with a roller to tightly press a sheet wound onto the rotary drum, so that uneven adhesion of the sheet onto the roller can be prevented. However, since the conventional device causes the sheet to be constantly and tightly pressed against the circumferential surface of the drum by the operation of the sheet pressing roller, any stain on the printed surface of a draft can easily be transferred to the surface of the roller, and then be passed on to the printed surface of subsequent sheets, thus affecting the appearance of those sheets.

SUMMARY OF THE INVENTION

The present invention effectively eliminates the disadvantage inherent in the conventional devices mentioned above. The present invention aims at providing an automatic sheet winding and discharging device that securely prevents all the subsequent sheets from being soiled by causing the sheet pressing roller to press a sheet against the circumferential surface of the drum only when such pressing operation is needed so that even the lightest stain on a pressed sheet cannot be transferred onto the sheet pressing roller.

Another object of the present invention is to provide an automatic sheet winding and discharging device suitable for the printing device of, for example, a copying machine by locating the tip portion of the first nail either very close to or in contact with the apertures opposite the surface of the drum when the delivered sheet is held by the sheet holding means.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from the following detailed description.

To realize the above objects, according to one of the preferred embodiments of the present invention, an automatic sheet winding and discharging device is provided, whose mechanical components include the following: a rotary drum for winding a sheet onto its circumferential surface; sheet holding means provided on the circumferential surface of the drum for holding the tip end of the delivered sheet; a sheet holding roller provided in the vicinity of a sheet outlet for holding the sheet; and means for causing the sheet holding roller to selectively contact the circumferential surface of the drum, while automatically winding the sheet onto and discharging it from the rotary drum.

According to another preferred embodiment of the present invention, an automatic sheet winding and a discharging device consists of the following: a rotary drum for winding the sheet onto its circumferential surface; a first nail for positioning the tip end of the sheet, where the first nail protrudes from the aperture in the surface of the rotary drum; a second nail that holds the tip end of the sheet together with the first nail and strips the sheet from the rotary drum; and cam means that causes the first and second nails to operate in response to the rotation of the rotary drum, whereby the tip end of the first nail is arranged so that it is either close to or comes into contact with the aperture edge in the surface of the rotary drum when the sheet edge is held by the first and second nails.

BRIEF DESCRIPTION OF THE DRAWINGS

The present invention will be better understood from the detailed description given hereinbelow and the accompanying drawing which are given by way of illustration only and are thus not limitative of the present invention in which.

DETAILED DESCRIPTION OF THE PREFERRED EMBODIMENTS

Figure 1:
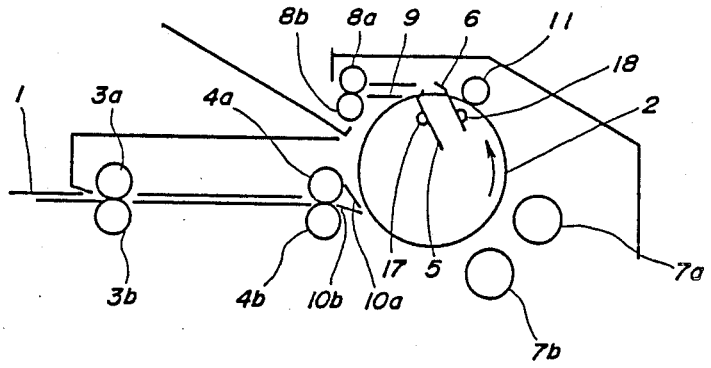
FIG. 1 is a schematic illustration of a copying machine incorporating the automatic sheet winding and discharging device reflecting one of the preferred embodiments of the present invention.

Referring now to the accompanying drawings, one of the preferred embodiments of the present invention is described below. FIG. 1 is a schematic illustration denoting an automatic sheet winding and discharging device embodied by the present invention when it is applied to the draft forwarding device of a copying machine.

In FIG. 1, reference number 1 indicates a draft paper. Reference number 2 indicates a drum that winds the draft paper. Reference numbers 3*a* and 3*b* indicate paper forwarding rollers, and reference numbers 4*a* and 4*b* indicate timing rollers. The reference numbers 5 and 6 indicate sheet holding nails, which have tip ends protruding from the an aperture in the surface of the drum 2. These nails 5 and 6 are respectively installed to shafts 17 and 18 inside the drum 2 to allow their free rotation. A control mechanism opens and closes both nails as required. Reference numbers 7*a* and 7*b* indicate exposure lamps and a wire sheet holder is provided in front of these exposure lamps. Reference numbers 8*a* and 8*b* indicate sheet discharging rollers, 9 indicates a sheet discharging guide and 10*a* and 10*b* indicate sheet feeding guides. Reference number 11 indicates a sheet holding roller which consists of a sheet discharging roller and a sheet discharging guide, while the sheet holding roller unit is installed in a position very close to the sheet discharger.

Figure 2:
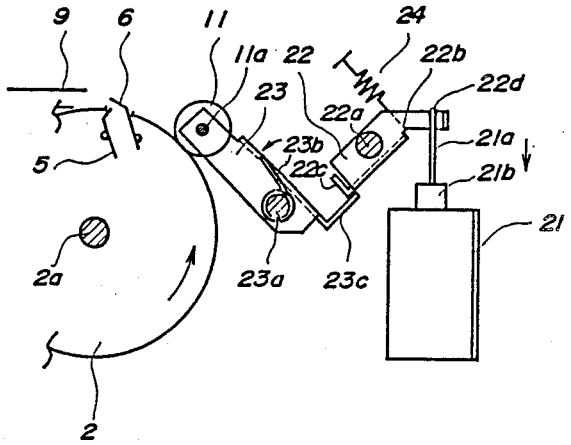
FIG. 2 is a schematic illustration denoting the control mechanism of the sheet holding roller.

FIG. 2 is a simplified block diagram illustrating the control mechanism of the sheet holding roller 11. The sheet holding roller unit 11 is installed at one end of a lever 23 so that it can freely rotate. The lever 23 is fixed to a shaft 23*a* secured to the body so that it can freely rotate as shown in FIG. 2. In addition, the lever 23 is constantly energized by a spring 23*b* in a counterclockwise direction. The other end 23*c* of this lever 23 is L-shaped so that it can correctly face the tip end 22*c* of the other lever 22. The lever 22 is fixed to a shaft 22*a* (secured to the body) and can rotate freely. The part 22*b*, fixed at an angle to the lever 22, is provided with a coil spring 24, while a tip end 22*d* of the angled part 22*b* is provided with a wire 21*a* which is connected to a movable iron core 21*b* of a solenoid 21. As soon as the solenoid 21 receives current to cause the movable iron core 21*b* to move downward in the arrowed direction, lever 22 rotates clockwise against the force of the coil spring 24, causing the tip end 22*c* of the lever 22 disengage from the L-shaped edge 23*c* of the other lever 23. As a result, due to the energized force of the spring 23*b*, the lever 23 rotates counterclockwise, causing the sheet holding roller 11 located at the end of the lever 23 to be pressed against the circumferential surface of the drum 2 that winds the draft paper. Conversely, when the current is cut off from the solenoid 21, the lever 22 rotates counterclockwise by the effect of the coil spring 24. Simultaneously, the tip end 22*c* of the lever 22 presses the tip end 23*c* of the other lever 23 downward, and the lever 23 thus rotates clockwise to cause the sheet holding roller 11 to leave the circumferential surface of the drum 2. In other words, as soon as the solenoid 21 receives current, the control mechanism starts to function so that the sheet holding roller 11 can be pressed against the circumferential surface of the drum 2. Conversely, when the flow of current is cut off from the solenoid 21, the control mechanism then functions so that the sheet holding roller 11 can ascend from the circumferential surface of the drum 2.

Figure 3:
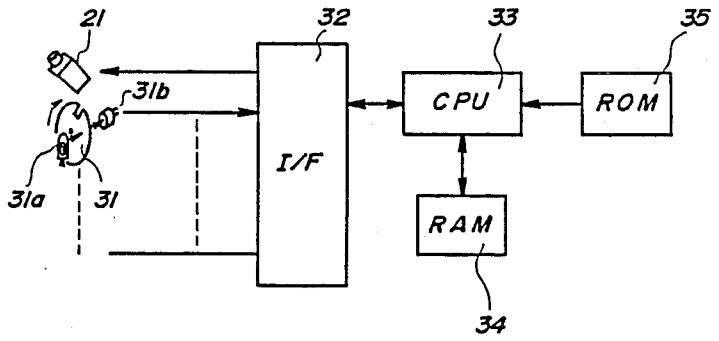
FIG. 3 is a block diagram of a control circuit of the sheet holding roller.
Figure 4:
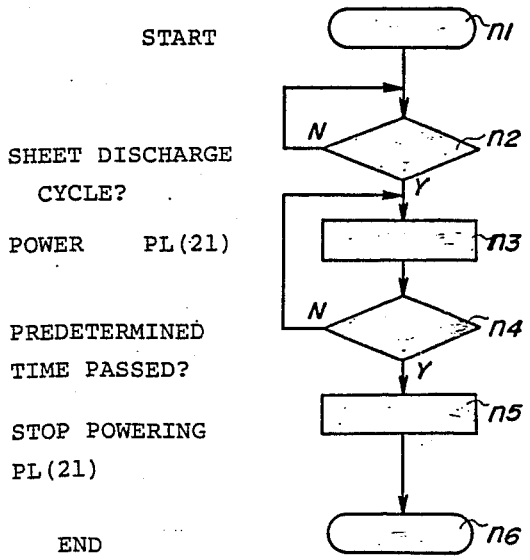
FIG. 4 is a flowchart related to the control circuit of the sheet holding roller.

FIG. 3 is a block diagram of the control circuit of the sheet holding roller control mechanism described above, while FIG. 4 is a simplified flowchart denoting the operation of the control mechanism. Referring now to these drawings, the operation of the control mechanism is described in detail below. Reference number 32 is a input/output interface circuit. Reference number 33 indicates a central processing unit (CPU). Number 34 indicates a read-write memory, and 35 indicates a read-only memory. The control circuit controls via the input/output interface circuit 32 both the input and output of either signal of the solenoid 21 or the timing signal generated by both a slit disc 31 set to a rotary shaft 2*a* of the drum 2 and the photo-projector/receptors 31*a* and 31*b* that detect slits of the slit disc 31.

When a draft paper is wound onto the drum 2, the CPU 33 of the control circuit first identifies in step 2 of the flowchart whether the operation mode is in the draft-discharging cycle. If the draft discharging cycle is underway, the operation mode proceeds to step 3 to flow current through the solenoid 21, and the draft sheet wound onto the drum 2 is then tightly pressed against the circumferential surface of the drum 2 by the sheet holding roller 11. Next, when the operation mode enters step 4, the CPU 33 identifies whether a specific time has passed from the moment when current was allowed to flow through solenoid 21. Note that after the specific period of time, that is, from the moment when the draft sheet discharging cycle starts till this cycle is completed, the operation mode proceeds to step 5 to stop the flow of current and as a result, the control mechanism causes the sheet holding roller 11 to leave the surface of the drum 2.

According to the above mentioned construction of the control mechanism, the draft sheet 1 inserted into the copying machine from the draft inlet is then carried to the clipper, i.e., into the space between nails 5 and 6 by means of the sheet forwarding roller 3*a* and 3*b*, and the timing rollers 4*a* and 4*b* so that the tip end of the draft sheet can be held by the closing operation of nails 5 and 6. Next, the draft sheet 1 passes through the exposure unit while still being wound onto the circumferential surface of the rotating drum 2, where the draft sheet 1 is sequentially subjected to the exposure process by means of lamps 7*a* and 7*b*. The drum 2 keeps rotating until copying of a predetermined number of sheets is completed. However, no current flows through the solenoid 21 while the drum 2 rotates, and therefore, the sheet holding roller 11 remains apart from the draft sheet 1 on the drum 2. After a specific number of papers have been copied, the operation mode enters the draft-sheet discharging cycle. In this cycle, current again flows through solenoid 21 to cause the sheet holding roller 11 to move in the direction of the drum 2 so that the draft sheet 1 can be securely held in position. Copied papers are then discharged from the machine while the mechanism remains in the above status. As soon as the paper discharging cycle is completed, the control circuit stops the flow of current through the solenoid 21 to cause the sheet holding roller 11 to leave the drum 2. As described above, the control mechanism causes the sheet holding roller 11 to remain apart from the draft sheet 1 wound onto the circumferential surface of the drum 2 during all the operational modes except for the draft discharging cycle. As a result, such a mechanism can prevent the adhesion of stains on the draft sheets passing to the sheet holding roller 11 and then to subsequent sheets. As is clear from the foregoing description, such an automatic sheet winding and discharging device reflecting one of the preferred embodiments of the present invention provides the means for causing the sheet holding roller to securely leave and come into contact with the circumferential surface of the rotating drum. As a result, such an automatic sheet winding and discharging device can prevent even the slightest soiling of the sheet holding roller and consequently all the following sheets from being soiled.

Figure 5:
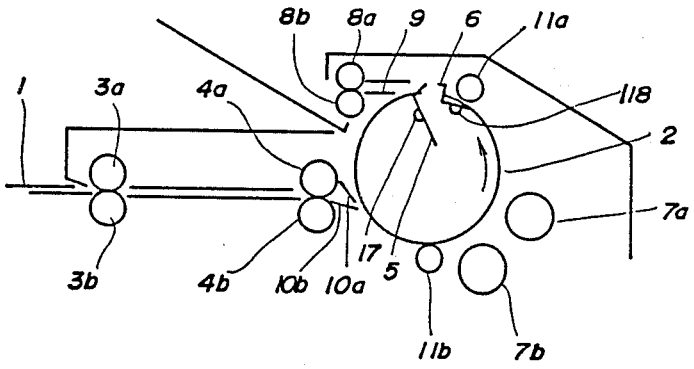
FIG. 5 is a schematic illustration of the automatic sheet winding and discharging device reflecting another preferred embodiment when applied to the draft forwarding device of a copying machine.

FIG. 5 is a schematic illustration of the draft-forwarding device of a copying machine incorporating an automatic sheet winding and discharging device reflecting another preferred embodiment of the present invention.

In FIG. 5, the draft sheet 1 is forwarded to the draft support device of the drum 2 which is provided with the first nail 5 and the second nail 6 by means of the paper forwarding rollers 3*a* and 3*b*, and the timing rollers 4*a* and 4*b*. This device, reflecting another preferred embodiment of the present invention, first causes the first nail 5 and the second nail 6 to hold the tip end of draft sheet 1, which is then wound onto the drum 2 while being exposed to the light sources 7*a* and 7*b*. The drum 2 then performs a designated number of rotations and repeatedly applies exposure to the draft sheets. After completing the designated operations, draft sheets are released from the holding device, then respectively stripped from the drum 2 by the second nail 6 before eventually being sent out of the copying machine via discharging rollers 8*a* and 8*b*.

Figure 6:
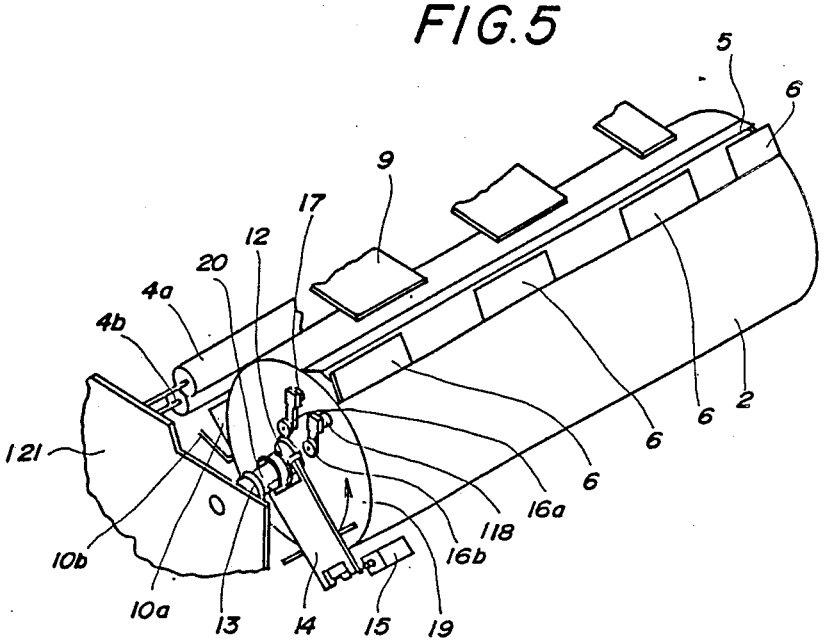
FIG. 6 is a perspective view of the drum that winds draft paper onto its circumferential surface.
Figure 7:
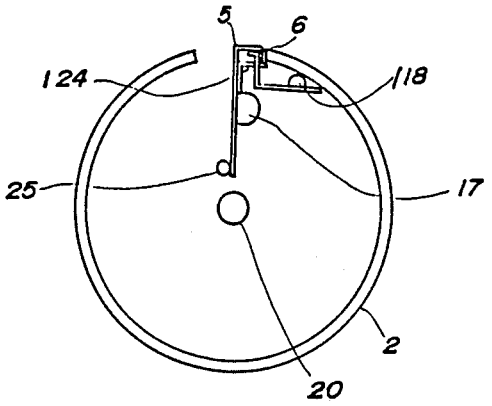
FIG. 7 is a sectional view of the drum that winds draft paper onto its circumferential surface.
Figure 8A:
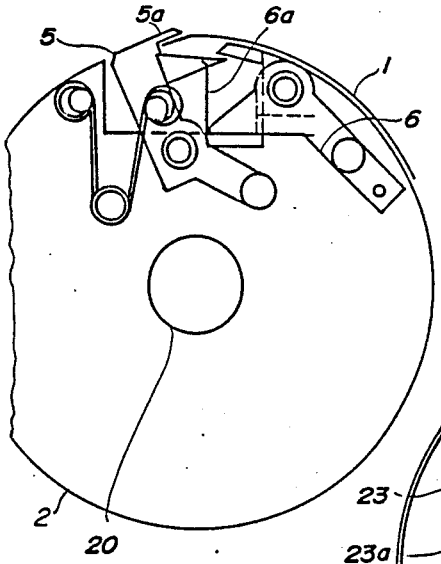
FIG. 8 (*a*), (*b*), and (*c*) respectively are diagrams showing the structure and operations of the first and second nails.
Figure 8B:
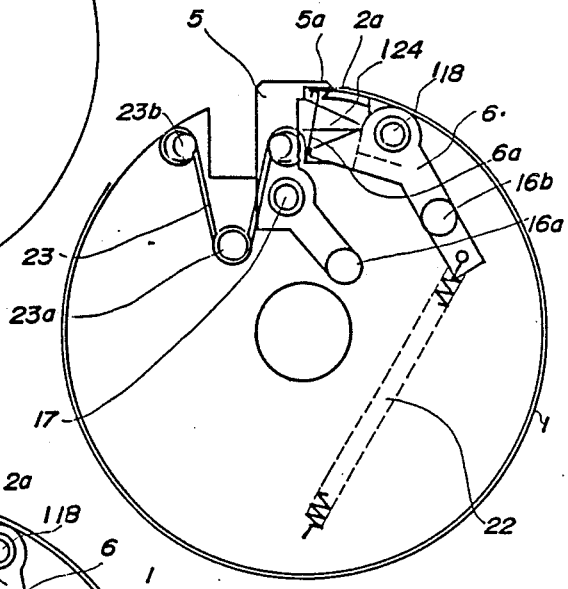
Figure 8C:
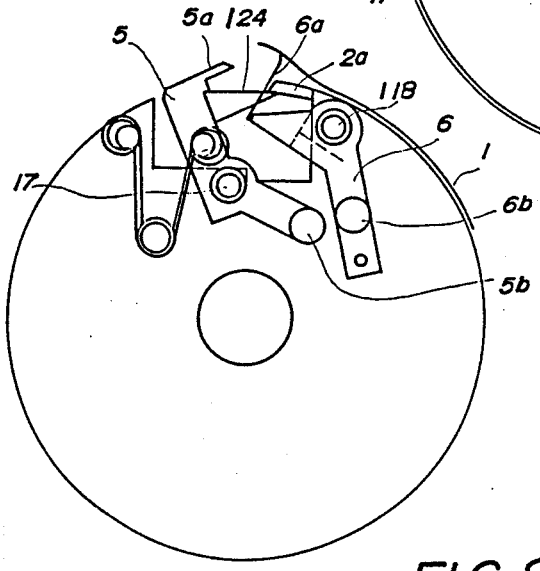

FIG. 6 is a perspective view of the drum 2, while FIG. 7 is a sectional view of the drum 2. The first nail 5 and the second nail 6 are respectively secured to shafts 17 and 118 supported by a side board 19. A drum shaft 20 that supports and rotates the drum 2 is provided with a cam 12 (12*a* and 12*b*) which is fixed independently of the rotation of the drum shaft and a compressed coil spring 13 that presses the cam 12 in the direction of the side board 19 of drum 2. Reference numbers 16*a* and 16*b* are cam followers connected to shafts 17 and 118. These cam followers 16*a* and 16*b* come into contact with the corresponding cams 12*a* and 12*b* when the drum 2 rotates in the arrowed direction. This allows both shafts 17 and 118 to rotate at a specific angle. Rotation of these shafts 17 and 118 activates the opening and closing operations of the first nail 5 and the second nail 6. A solenoid 15 causes a movable plate 14 that moves the cam 12 to shift its position in the axis direction of the drum shaft 20. In other words, the solenoid 15 causes the cam 12 to shift its position to a side of the frame 121 so that the cam 12 can be disengaged from the cam followers 16*a* and 16*b*. This allows the drum 2 that wound the draft sheet 1 to rotate a specific number of times without performing the paper discharging operation. The first nail 5 and the second nail 6 are installed in the manner shown in FIG. 8. The rotating shaft 118 of the second nail 6 is placed in a position as far from the axis 20 of the drum 2 as possible, i.e., it is provided in the vicinity of the circumferential surface of the drum 2. This configuration minimizes the distance between the tip end 6*a* of the second nail 6 and the drum aperture edge 2*a* when the second nail 6 sandwiches the draft sheet 1 with the first nail 5. Conversely, when the tip end 5*a* of the first nail 5 sandwiches the draft sheet 1 together with the tip end 6*a* of the second nail 6, the tip end 5*a* comes into contact with the aperture edge 2*a* of the drum 2 as shown in FIG. 8(*b*) so that no gap can be formed between the tip end 5*a* and the aperture edge 2*a*. Note that FIG. 8(*a*) denotes the state when a sheet is inserted, FIG. 8(*b*) denotes the state when the inserted sheet is held, and FIG. 8(*c*) denotes the state when the inserted sheet is stripped from the drum 2.

Next, operation of the automatic sheet winding and discharging device reflecting another preferred embodiment is described below.

Figure 9:
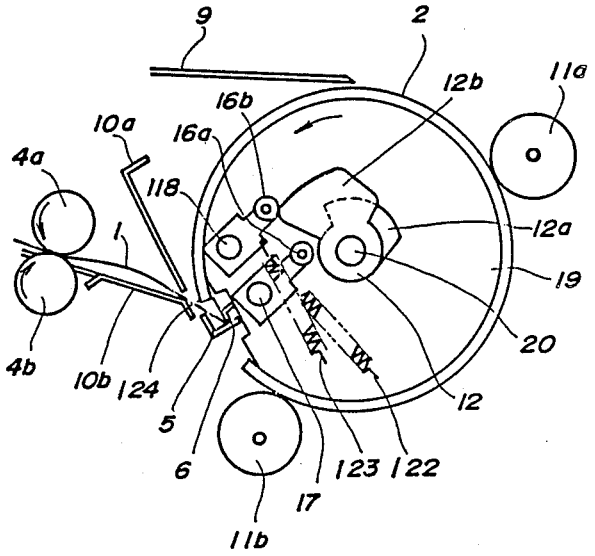
FIGS. 9 and 10 respectively are diagrams showing the operating condition of the automatic sheet winding and discharging device when loading a draft paper.
Figure 10:
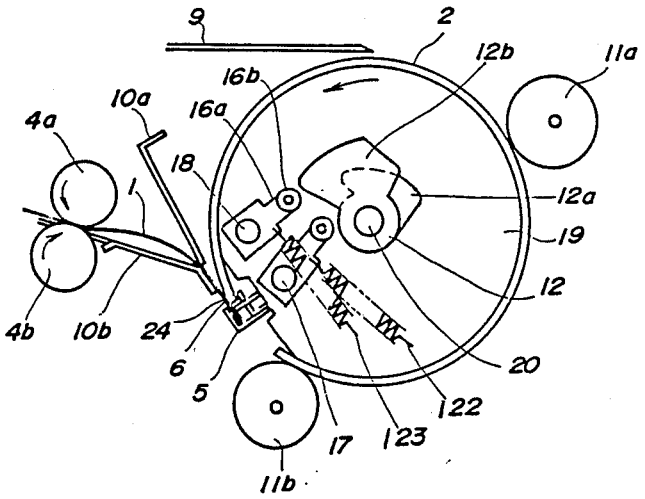
Figure 11:
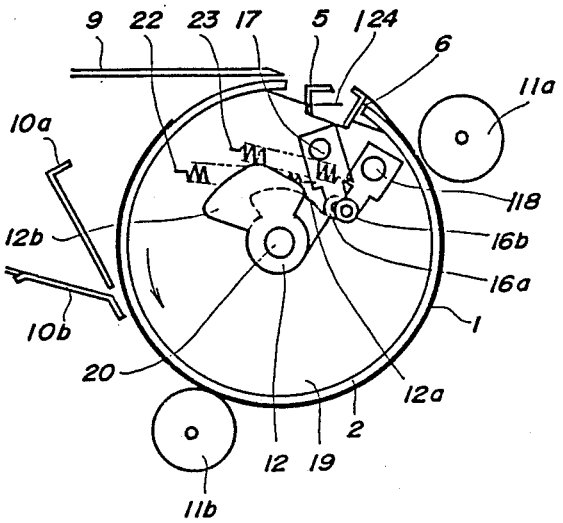
FIG. 11 is a diagram showing the operating condition of the automatic sheet winding and discharging device when discharging draft paper from it.

FIGS. 9 and 10 show the operating conditions of the respective components when the draft sheet 1 is loaded onto the drum 2. FIG. 11 shows the operating conditions of those components when the draft sheet 1 is discharged. Referring now to FIGS. 9 and 10, the first nail 5 and the second nail 6 are respectively energized by the tensile coil springs 122 and 123 so that both of these nails can move in a clockwise direction. The cams 12*a* and 12*b* are shaped as shown in the drawings so that they match the opening and closing motions of nails 5 and 6. When the rotating drum 2 reaches the position for loading the draft sheet 1, the nail 5 is in the closed condition with the cam follower 16*a* being disengaged from cam 12*2*, whereas the second nail 6 is in the internally open condition with the inverted cam 16*b* being pushed up by the cam 12*b*. The draft sheet 1 is first carried to the timing rollers 4*a* and 4*b* by means of the paper forwarding rollers 3*a* and 3*b* shown in FIG. 5, and then stops for a moment. When both the first nail 5 and the second nail 6, the draft holders of the drum 2, rotate to the designated position, the draft sheet 1 under the stand-by mode is again sent forward at a speed faster than the rotation of the drum 2, and inserted between the first nail 5 and a guide 124. Next, as shown in FIG. 10, the cam follower 16*b* is disengaged from the cam 12*b*. The second nail 6 then presses the tip end of the draft sheet 1 against the first nail 5, and then the drum 2 rotates to a position where the draft sheet 1 is held by the force of the tensile coil spring 23 so that its loading can be completed. In this condition, as shown in FIG. 7 and FIG. 8(*b*), the tip end 5*a* of the first nail 5 remains in contact with the aperture edge 2*a* in the drum 2 so that no gap between the tip end 5*a* of the first nail 5 and the aperture edge 2*a* of the drum 2 can be formed.

When the drum 2 starts to wind the draft sheet 1 onto its surface, the driving force to the timing roller 4*b* stops. This is because the timing roller 4*b* forwards the draft sheet at a speed faster than the rotation of the drum 2. However, in this condition, the timing roller 4*b* stops the operation. Therefore, the automatic sheet winding and discharging device reflecting another preferred embodiment is provided at both ends of the timing roller 4*b* with one-way clutches, and thus, after discontinuing the driving operation of the timing roller 4*b*, the drum 2 idles through the force pulling the draft sheet 1. Note that the timing roller 4*a* constantly idles.

This completes the winding of the draft sheet 1 onto the drum 2.

Conversely, when discharging the draft sheet 1 from the drum 2, as shown in FIG. 11, as soon as the draft sheet 1 approaches the draft sheet discharging position formed by the first nail 5 and the second nail 6, the inverted cam 16*a* is pushed upward by the cam 12*a* so that the first nail 5 opens itself. Then, the second nail 6 that presses the draft sheet 1 against the first nail 5 by force of the tensile coil spring 23 opens outward. Simultaneously, the second nail 6 pushes up the tip end of the draft sheet 1 to a position outside the paper discharging guide 9 before stripping off the draft sheet 1 from the drum 2. This is shown in FIG. 2 since the paper discharging guide 9 and the second nail 6 are installed in such positions that when the draft sheet supporting part passes through the paper discharging guide 9 at the draft discharging position, even if the second nail 6 projects from the circumferential surface of drum 2 together with the draft sheet 1, the second nail 6 can pass by the paper discharging guide 9 without touching it, while only the draft sheet 1 is caught by the paper discharging guide 9, and as a result, in accordance with the rotation of the drum 2, the draft sheet 1 is sequentially stripped from the drum 2 by means of the paper holding roller 11 (11*a* and 11*b*), the paper discharging guide 9, and the paper discharging rollers 8*a* and 8*b* before eventually being sent out of the copying machine. Both the first nail 5 and the second nail 6 are brought back to the draft awaiting state by the cam 12 until they are rotated to the draft sheet loading position.

As is clear from the foregoing description, the automatic sheet winding and discharging device reflecting another preferred embodiment of the present invention causes the tip end 5*a* of the first nail 5 to come into contact with the aperture edge 2*a* of the drum while the draft sheet 1 is still wound onto the circumferential surface of drum so that no gap between these can be formed. Consequently, when the draft sheet is subjected to the exposure process, the close contact of the tip end of the first nail and the drum aperture edge effectively prevents even the slightest black streak from being caused by the presence of a gap between them, thus making it possible for the copying machine to constantly achieve extremely fine copying results.

As described above, the automatic sheet winding and discharging device reflecting another preferred embodiment of the present invention features a unique configuration that allows the tip end of the first nail to either approach very close to or come into contact with the opposite aperture edge of the surface of the drum when the edge of a sheet is held by the first and second nails, and therefore, when applying this device to a printing machine such as a copying machine, it is possible to achieve extremely satisfactory printing completely free from stains or spots.

While only certain embodiments of the present invention have been described, it will be apparent to those skilled in the art that various changes and modifications may be made therein without departing from the spirit and scope of the present invention as claimed.

What is claimed is:

1. An automatic sheet winding and discharging device in an electrophotographic copying machine, comprising:

a drum rotatable about a central axis for receiving a sheet thereon;

means, provided on the circumferential surface of said drum for gripping only the tip-end of the sheet in an automatic winding cycle for winding the sheet on to said drum;

sheet holding roller means for selectively pressing against the sheet wound onto the circumferential surface of said drum;

a sheet discharger unit operable only in an automatic sheet discharge cycle for discharging the sheet from said drum, said sheet discharger unit including a sheet discharging roller and sheet discharging guide; and means for selectively actuating said sheet holding roller means to contact the sheet wound on the circumferential surface of said drum only in the automatic discharge cycle thereby preventing said sheet holding roller means from contacting said sheet in the automatic winding cycle, said means for selectively actuating including means for determining whether said copying machine is in a sheet winding cycle or a sheet discharging cycle, and means for counting a predetermined lapse of time in the sheet discharging cycle, whereby upon determination of the sheet discharging cycle the predetermined lapse of time is counted at the end of which said sheet holding roller means is moved out of contact with said drum.

2. An automatic sheet winding and discharging device for an electrophotographic copying machine, comprising:

a drum rotatable about a central axis for receiving a sheet thereon prior to a copying operation;

a first nail member, extending outwardly from an aperture provided in the periphery of the circumferential surface of said drum, for aligning only the tip-end of the sheet on the drum in an automatic sheet winding cycle;

a second nail member for gripping only the tip-end of the wound sheet together with said first nail member and for stripping only the tip-end of the wound sheet from the circumferential surface of said drum in an automatic sheet discharge cycle;

first and second shaft members positioned within said drum for enabling free rotation of said first and second nail members, respectively, about independent axes for free lateral movement of said first and second nail members within the aperture of said drum;

cam means for activating said first and second nail members in response to rotation of said drum, said cam means being provided on independent axes within said drum;

cam followers provided on each of said first and second shaft members, said cam followers being selectively engaged by said cam means; and means for moving said cam means in an axial direction into and out of engagement with said cam followers provided on each of said first and second shaft members, wherein said drum having a draft sheet wound thereon can rotate a predetermined number of times without initiating the paper discharging cycle and upon engagement of said cam means with said cam followers will enable said paper discharge cycle;

said cam means operating to position the tip-end of said first nail member to be in contact with the aperture edge on the circumferential surface of the drum when the leading edge of the sheet is gripped between said first and second nail members in order to eliminate any openings in the periphery of said drum, thereby preventing a black streak from being copied onto a copy paper sheet.

3. The device according to claim 2, wherein said first shaft member is positioned away from the rotating axis of said drum and adjacent the circumferential surface thereof for minimizing the distance between the tip of said second nail member and the aperture edge when said second nail member grips the paper sheet with said first nail member.

* * * * *